US006724571B2

(12) United States Patent
Dinan et al.

(10) Patent No.: US 6,724,571 B2
(45) Date of Patent: Apr. 20, 2004

(54) MAGNETIC HEAD FOR HARD DISK DRIVE HAVING VARIED COMPOSITION NICKEL-IRON ALLOY MAGNETIC POLES

(75) Inventors: Thomas Edward Dinan, San Jose, CA (US); Neil Leslie Robertson, Palo Alto, CA (US); Alan Jun-Yuan Tam, Berkeley, CA (US)

(73) Assignee: International Business Machines Corporation, Armonk, NY (US)

( * ) Notice: Subject to any disclaimer, the term of this patent is extended or adjusted under 35 U.S.C. 154(b) by 324 days.

(21) Appl. No.: 09/952,741

(22) Filed: Sep. 13, 2001

(65) Prior Publication Data

US 2002/0154442 A1 Oct. 24, 2002

Related U.S. Application Data

(63) Continuation-in-part of application No. 09/839,901, filed on Apr. 20, 2001.

(51) Int. Cl.[7] ..... G11B 5/31

(52) U.S. Cl. ..... 360/126

(58) Field of Search ..... 360/125, 126

(56) References Cited

U.S. PATENT DOCUMENTS

| | | | | |
|---|---|---|---|---|
| 4,869,971 A | | 9/1989 | Nee et al. | 428/635 |
| 5,570,251 A | | 10/1996 | Shinoura et al. | 360/126 |
| 5,751,528 A | * | 5/1998 | Nepela et al. | 360/126 |
| 5,932,082 A | | 8/1999 | Harris et al. | 205/259 |
| 6,025,978 A | | 2/2000 | Hoshi et al. | 360/113 |

* cited by examiner

*Primary Examiner*—George J. Letscher
(74) *Attorney, Agent, or Firm*—Robert O. Guillot; IPLO Intellectual Property Law Offices

(57) ABSTRACT

A magnetic head for a hard disk drive. The magnetic poles of the head are formed with a NiFe alloy having a graduated composition in which a higher Fe concentration is fabricated proximate the write gap layer between the magnetic poles. Each magnetic pole is fabricated in a single electroplating step in which the duty cycle of the electroplating current is altered during the electroplating operation. Where the duty cycle is greatest the Fe ion concentration is likewise greatest.

14 Claims, 5 Drawing Sheets

MAGNETIC HEAD FOR HARD DISK DRIVE HAVING VARIED COMPOSITION NICKEL-IRON ALLOY MAGNETIC POLES

CROSS REFERENCE TO RELATED APPLICATION

This application is a Continuation-in-Part application of copending U.S. patent application Ser. No. 09/839,901, filed Apr. 20, 2001.

BACKGROUND OF THE INVENTION

1. Field of the Invention

The present invention relates generally to magnetic heads for hard disk drives and particularly to magnetic heads having magnetic poles that are formed with a varied nickel-iron alloy composition.

2. Description of the Prior Art

Magnetic heads are generally fabricated utilizing photolithographic, electroplating and thin film deposition techniques to create magnetic shields, magnetic poles and other components on an upper surface of a wafer substrate. In fabricating the magnetic poles utilizing electroplating techniques, a seed layer is first deposited upon a surface of the head, typically utilizing sputter deposition techniques, followed by the fabrication of a patterned photoresist layer, followed by the electroplating of NiFe magnetic pole material upon exposed portions of the seed layer. The magnetic poles are generally composed of a NiFe compound, and it is well known that altering the ratio of Ni and Fe within the pole material will alter the magnetic properties of the pole. For instance, NiFe 80/20 (permalloy) is generally suited best for the main portions of magnetic poles, while NiFe 45/55 is a preferable composition for the portions of the P2 pole tip and of the P1 pole that are disposed adjacent each other with the write gap layer therebetween. Thus, it is known in the prior art to fabricate magnetic poles having separate segments which are composed of NiFe 80/20 and NiFe 45/55.

Where two pole segments composed of NiFe 80/20 and NiFe 45/55 are desired in a magnetic pole, two separate electroplating steps are conducted in which two separate plating baths are utilized, each having a different chemical makeup. Thus, in fabricating such magnetic poles, the first NiFe segment is fabricated in a first electroplating step utilizing the first plating bath, and the second segment is next fabricated in a second electroplating step utilizing the second plating bath.

A need therefore exists for a simplified magnetic pole fabrication method for creating magnetic poles having a varied NiFe ion concentration ratio. The improved magnetic head of the present invention includes magnetic poles having a graduated NiFe ion concentration ratio, in which the poles are fabricated in single electroplating steps, as is described in detail herebelow.

SUMMARY OF THE INVENTION

The hard disk drive of the present invention includes a magnetic head wherein the magnetic poles are formed with a NiFe alloy having a varied composition. The poles are created in a single electroplating process using only a single plating bath, by selecting and altering the electroplating process parameters during the electroplating process. In the preferred embodiment, both the P1 pole and the P2 pole are fabricated with a graduated composition NiFe alloy material. The P1 pole is preferably fabricated such that the initially electroplated lower portions have a relatively low Fe wt. % composition, and the upper P1 pole portions, proximate the write gap layer (which is subsequently fabricated) have a relatively high Fe wt. % composition. The initially electroplated lower portions of the P2 pole (proximate the write gap layer) are fabricated with a relatively high Fe wt. % composition, and the subsequently electroplated upper portions of the P2 pole have a relatively low Fe wt. % composition.

In the NiFe electroplating method of the present invention, the wt. % composition of Ni and Fe in NiFe electroplated material is controlled by selection of the duty cycle of the electroplating current during the electroplating process. Generally, for a particular electroplating bath, where the electroplating current duty cycle is greatest the NiFe electroplated material has a higher Fe wt. %, and where the electroplating current duty cycle is reduced, a lower Fe wt. %.

Therefore, electroplated NiFe components from a single electroplating bath can have differing NiFe concentrations where the electroplating current duty cycle is altered. Particularly, NiFe components can be electroplated with a graduated or changing Ni and Fe concentration by altering the electroplating current duty cycle during the electroplating process. Additionally, the plating rate of the poles can be varied as another way to alter the wt. % composition of Fe in the NiFe plating material during the electroplating process.

It is an advantage of the magnetic head of the present invention that it includes magnetic poles having a graduated Fe concentration.

It is another advantage of the magnetic head of the present invention that it includes magnetic poles in which portions of the magnetic poles that are disposed proximate the write gap layer have higher Fe concentrations than other portions of the magnetic poles.

It is a further advantage of the magnetic head of the present invention that it is easier and less expensive to manufacture in that the graduated Fe concentration magnetic poles are fabricated in a single electroplating process.

It is an advantage of the hard disk drive of the present invention that it includes a magnetic head of the present invention that includes magnetic poles having a graduated Fe concentration.

It is another advantage of the hard disk drive of the present invention that it includes a magnetic head of the present invention that includes magnetic poles in which portions of the magnetic poles that are disposed proximate the write gap layer have higher Fe concentrations than other portions of the magnetic poles.

It is a further advantage of the hard disk drive of the present invention that it includes a magnetic head of the present invention that is easier and less expensive to manufacture in that the graduated Fe concentration magnetic poles are fabricated in a single electroplating process.

These and other features and advantages of the present invention will no doubt become apparent to those skilled in the art upon reading the following detailed description which makes reference to the several figures of the drawings.

IN THE DRAWINGS

DETAILED DESCRIPTION OF THE PREFERRED EMBODIMENTS

Figure 1:
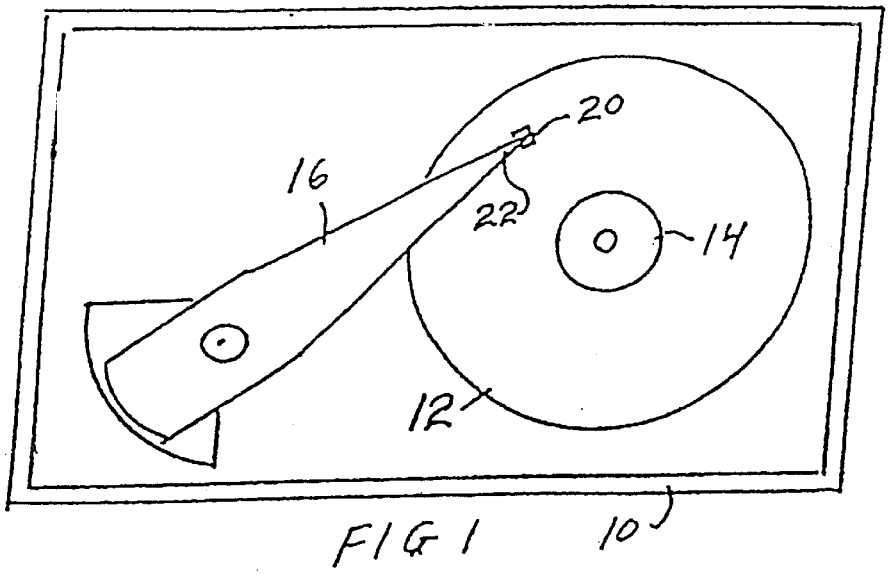
FIG. 1 is a top plan view of a typical hard disk drive including a magnetic head of the present invention.

FIG. 1 is a top plan view that depicts significant components of a hard disk drive, which includes the magnetic head of the present invention. The hard disk drive 10 includes a magnetic media hard disk 12 that is rotatably mounted upon a motorized spindle 14. An actuator arm 16 is pivotally mounted within the hard disk drive 10 with a magnetic head 20 of the present invention disposed upon a distal end 22 of the actuator arm 16. A typical hard disk drive 10 may include a plurality of disks 12 that are rotatably mounted upon the spindle 14 and a plurality of actuator arms 16 having a magnetic head 20 mounted upon the distal end 22 of each of the actuator arms. As is well known to those skilled in the art, when the hard disk drive 10 is operated, the hard disk 12 rotates upon the spindle 14 and the magnetic head 20 acts as an air bearing slider that is adapted for flying above the surface of the rotating disk. The slider includes a substrate base upon which the various layers and structures that form the magnetic heads are fabricated. Such heads are fabricated in large quantities upon a wafer substrate and subsequently sliced into discrete magnetic heads 20.

The magnetic heads 20 include components that are created in an electroplating process. These components, such as magnetic poles, are typically composed of electroplated NiFe, and the magnetic characteristics of these poles are determined by the relative composition of the Ni and Fe in the plated pole. Generally, substantial portions of the magnetic poles are advantageously composed of NiFe 80/20 (permalloy) which is a relatively low stress, low magnetostriction compound that has good magnetic flux conduction properties. However, the portions of the pole tip of the second magnetic pole (P2 pole) of a magnetic head located proximate the write gap layer are advantageously composed of a NiFe 45/55 composition, wherein the higher quantity of Fe (as compared to permalloy) creates superior magnetic flux conduction properties. In devices that include NiFe poles that have different compositions (such as 80/20 and 45/55) it has previously been necessary to utilize two different electroplating baths in order to plate up the NiFe poles with the differing compositions, as is next discussed.

Figure 2:
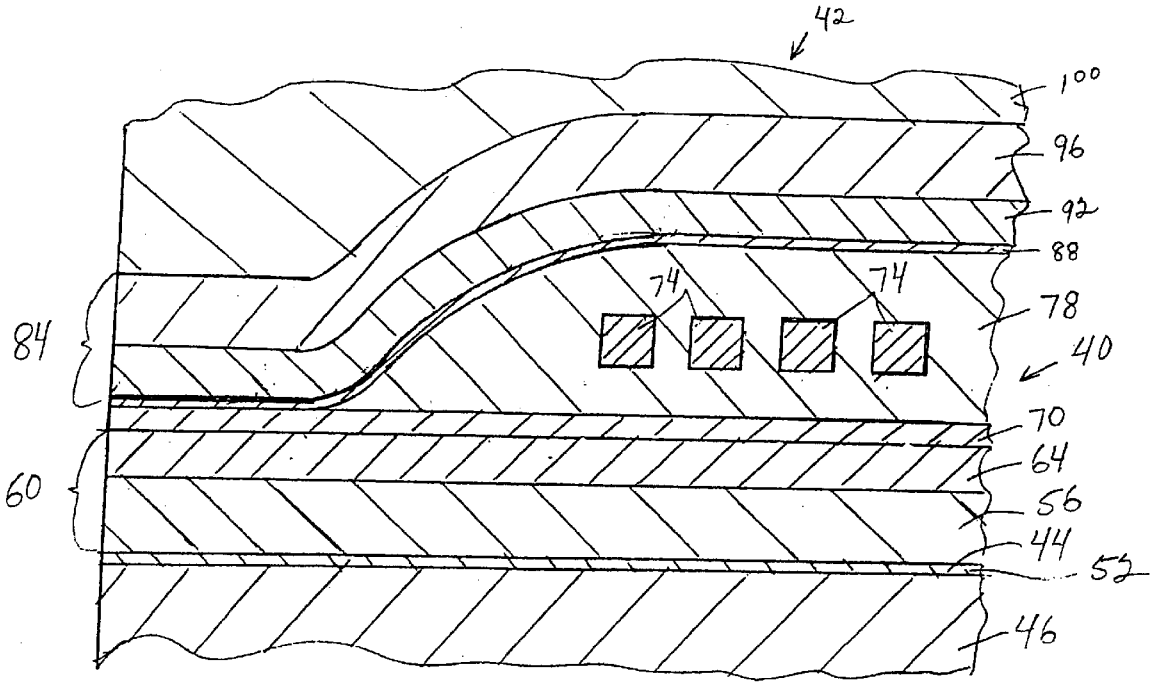
FIG. 2 (PRIOR ART)
FIG. 2 is a side cross-sectional view of a prior art write head portion of a magnetic head.

FIG. 2 is a cross-sectional view of a prior art write head portion 40 of a magnetic head 42 that is provided to facilitate the understanding of the present invention. As is well known to those skilled in the art, the write head structure 40 is fabricated utilizing photolithographic, electroplating and thin film deposition techniques upon an upper surface 44 of read head components 46 of the magnetic head 42. In fabricating the write head portion 40 of the prior art magnetic head, a first seed layer 52 is deposited upon an upper surface 44 of the read head 46, followed by the electroplating of a first segment 56 of a first (P1) magnetic pole 60. The first segment 56 is electroplated in a first electroplating bath and preferably has a relatively low Fe wt. % composition, such as a NiFe 80/20 composition. Thereafter, the wafer is placed in a second electroplating bath and a second segment 64 of the P1 pole 60 is electroplated, typically having a relatively high Fe wt. % composition, such as a NiFe 45/55 composition. Thereafter, the write gap layer 70 is deposited upon the second segment 64 of the P1 pole, and induction coil structures 74 are next fabricated within layers 78 of insulation material.

The fabrication of the P2 pole 84 is next commenced by the deposition of a seed layer 88 upon the write gap layer 70 and the insulative layer 78. Thereafter, a first segment 92 of the P2 pole 84 is electroplated in a first electroplating bath to have a relatively high Fe wt. %, such as NiFe 45/55. Thereafter, the wafer is placed in a second electroplating bath and a second segment 96 of the P2 pole 84 is electroplated to have a relatively low Fe wt. %, such as NiFe 80/20. Further fabrication steps, including an encapsulation layer 100, as are well known to those skilled in the art are thereafter performed to complete the fabrication of the prior art magnetic head 42.

It is therefore to be understood that the magnetic poles 60 and 84 of the prior art magnetic head each include two separate segments (56, 64 and 92, 96 respectively) having differing magnetic properties, and that these two segments of each pole are fabricated in separate electroplating steps utilizing separate electroplating baths. As is described herebelow, the present invention utilizes a single electroplating bath with a variation in the electroplating process parameters to control and alter the composition of the plated NiFe magnetic poles during the plating process. Magnetic poles are thereby produced having a varied and preferably graduated NiFe alloy composition. In the magnetic head of the present invention either the P1 pole or the P2 pole or both of the P1 and P2 poles can have the varied or graduated NiFe compositional structure of the present invention. The following description of the present invention will include a description of a magnetic head 20 having both a P1 pole and a P2 pole having a varied NiFe alloy compositional structure of the present invention.

Figure 3:
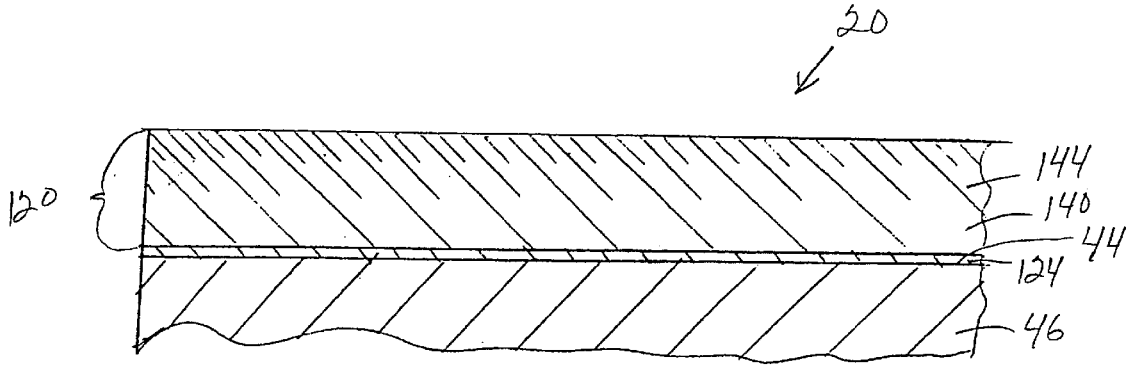
FIG. 3 is a side cross-sectional view of a fabrication step of a first magnetic pole (P1 pole) of the magnetic head of the present invention.

FIG. 3 is a side cross-sectional view depicting the fabrication of a P1 pole 120 of a magnetic head 20 according to the present invention. As depicted therein, an electroplating seed layer 124 is first deposited, such as by sputter deposition techniques, upon an upper surface 44 of a read head portion 46 of the magnetic head 20. The seed layer preferably has a low Fe wt. % composition, such as NiFe 80/20. Thereafter, the wafer containing the magnetic head 20 is placed in an electroplating bath, such as is described hereinbelow, and the electroplating process parameters are chosen to electroplate a lower portion 140 of NiFe magnetic pole material having a relatively low Fe wt. % concentration, such as NiFe 80/20. As is described in detail herebelow, the duty cycle of the electroplating current and/or the plating rate are the principal parameters that are chosen and varied in the magnetic pole electroplating process. When approximately one half of the thickness of the P1 magnetic pole 120 has been electroplated, the electroplating current duty cycle and/or the electroplating rate is altered, as described in detail herebelow, such that the Fe wt. % in the electroplated NiFe alloy is increased. As the P1 pole electroplating process continues, the electroplating process parameters may be further altered as electroplated material is deposited, such that the Fe wt. % composition in the upper portion 144 of the P1 pole 120 is increased, such as NiFe 45/55, or even NiFe 35/65. It is therefore to be understood that the P1 magnetic pole 120 of the present invention is fabricated in a single electroplating bath, in a single electroplating process in which the electroplating process parameters are varied, such that the Fe wt. % composition in the NiFe material of the P1 pole is controllably altered. A P1 magnetic pole 120 having a varied NiFe compositional structure is thereby achieved in a single electroplating step. Where the electroplating process parameters are altered continuously, a graduated NiFe compositional structure is achieved for the P1 pole 120 from a relatively low wt. % Fe to a relatively high wt. % Fe. Further process steps of the magnetic head of the present invention are next described with the aid of FIG. 4.

Figure 4:
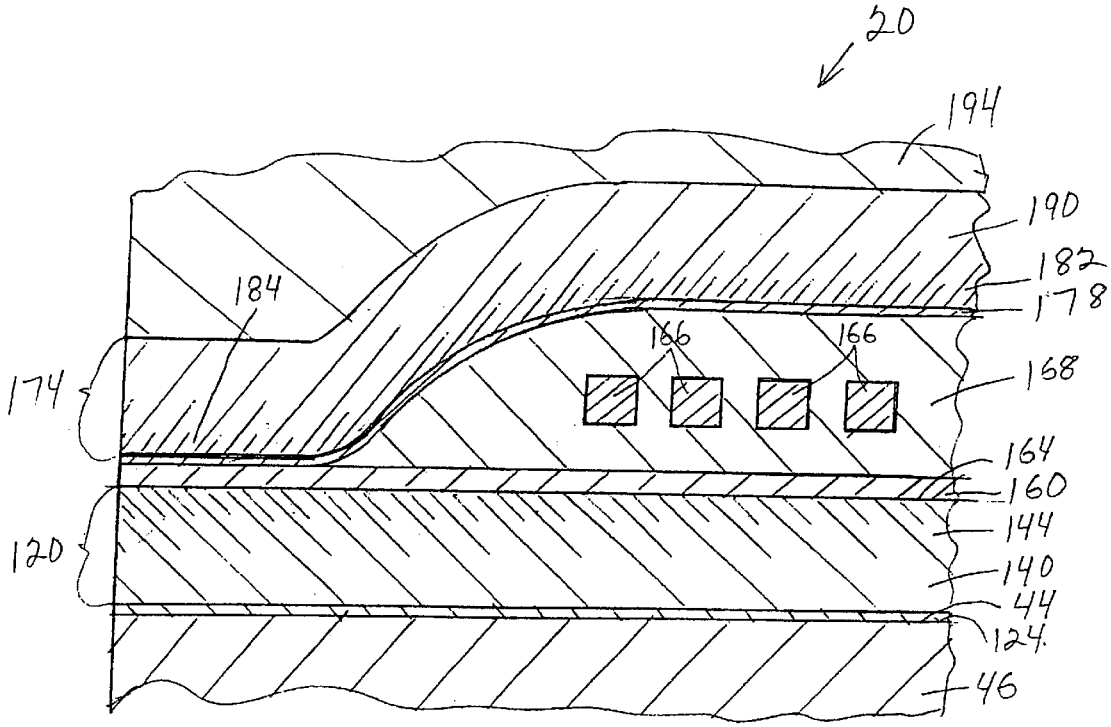
FIG. 4 is a side cross-sectional view of a further fabrication step for the second magnetic pole (P2 pole) of the magnetic head of the present invention.

FIG. 4 is a side cross-sectional view of the magnetic head of the present invention showing further fabrication steps following those depicted in FIG. 3 and described hereabove. As depicted in FIG. 4, a write gap layer 160 is subsequently deposited upon the upper surface 164 of the P1 pole 120. Thereafter, induction coil members 166 are fabricated within electrically insulative material 168, and the P2 pole 174 is next fabricated thereon. A first step in fabricating the P2 pole 174 is the deposition of a seed layer 178. Preferably, the seed layer 178 is fabricated in a sputter deposition step and has a relatively high Fe wt. % composition, such as NiFe 45/55 or even NiFe 35/65. Thereafter, a patterned photoresist (not shown) is photolithographically fabricated upon the seed layer 178. The wafer is next placed in an electroplating bath and the P2 pole 174 is electroplated onto the exposed portions of the seed layer 178. In the P2 pole electroplating process the electroplating process parameters are chosen such that the lower portion 182 of the P2 pole proximate the seed layer 178 is formed with a relatively high Fe wt. % NiFe alloy material. It is particularly significant that the relatively high Fe wt. % concentration lower portion 184 of the P2 pole tip is disposed across the write gap layer 160 from the relatively high Fe wt. % concentration portion 144 of the P1 pole 120. As is described in detail herebelow, the electroplating current duty cycle and the plating rate are the principal parameters which may be selectably varied to control the composition of the electroplated NiFe alloy. Generally, after approximately one quarter of the thickness of the P2 pole material has been deposited, the electroplating process parameters are altered such that the electroplating of the upper portion 190 of the P2 pole is conducted to produce a relatively low Fe wt. % in the NiFe alloy that is electrodeposited. Following the electroplating of the P2 pole 174, further fabrication steps including an encapsulation layer 194, as are well known to those skilled in the art are conducted to complete the fabrication of the magnetic head 20 of the present invention.

It is therefore to be understood that the magnetic head of the present invention may be fabricated with either, or both, of the P1 and P2 magnetic poles having a varied Fe wt. % NiFe composition, and that this varied NiFe composition is achieved in a single electroplating bath by altering the electroplating process parameters. Furthermore, the varied NiFe pole compositional structure may be fabricated to have a graduated composition by continuously altering the electroplating process parameters of the pole throughout the pole electroplating process. It is therefore contemplated that magnetic poles may be fabricated having portions that have a relatively constant Fe wt. % where the electroplating process parameters are held constant, and other portions that have different, or graduated, wt. % Fe concentrations where the electroplating process parameters are altered and/or continuously altered during the electroplating process. A detailed description of the electroplating process that is utilized to fabricate the magnetic head 20 of the present invention is next presented with the aid of FIGS. 5–10.

As is known to those skilled in the art, a standard NiFe electroplating bath, also known as a Watts bath, typically includes compounds such as nickel chloride, nickel sulfate, iron chloride and iron sulfate, with a typical plating current of approximately 8.0 $mA/cm^2$. The electroplating process is conducted with the current on, and the composition of the plated up material is generally dependent upon the percentage concentration of Ni and Fe ions within the electroplating bath Significantly, the inventors hereof have determined that varying the duty cycle of the plating current can result in a variation in the relative composition of Ni and Fe within the electroplated material. The duty cycle of the electroplating current is easily described with the aid of FIG. 5, which depicts an electroplating current pulse train.

Figure 5:
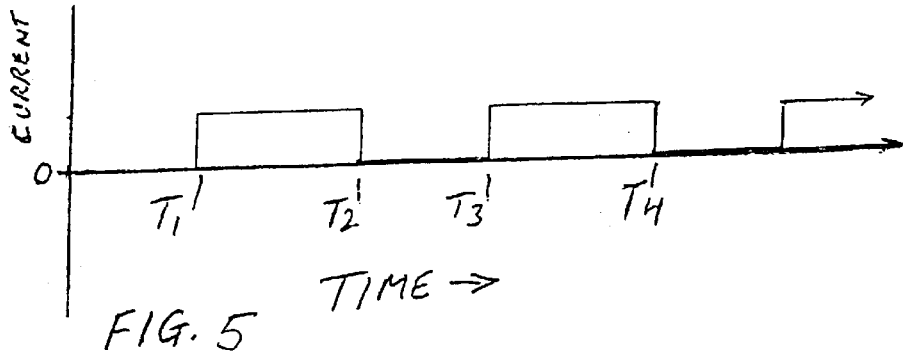
FIG. 5 is a graph which depicts an electroplating current profile that may be utilized in the present invention.

As depicted in FIG. 5, the electroplating current of the present invention is preferably though not necessarily a square wave, in which the current is on at time T1, off at time T2, on again time T3 and off again at T4, for a continuing repeated pulse train. Thus the current-on time is T2 minus T1, the current-off time is T3 minus T2, and the pulse period is the on time plus the off time (T3–T1). The duty cycle in pulse plating is defined as the current on time divided by the pulse period times 100 and represents the percentage of time during a pulse period that the electroplating current is on. That is, Duty Cycle=$((T2-T1)/(T3-T1))\times 100$.

Figure 6:
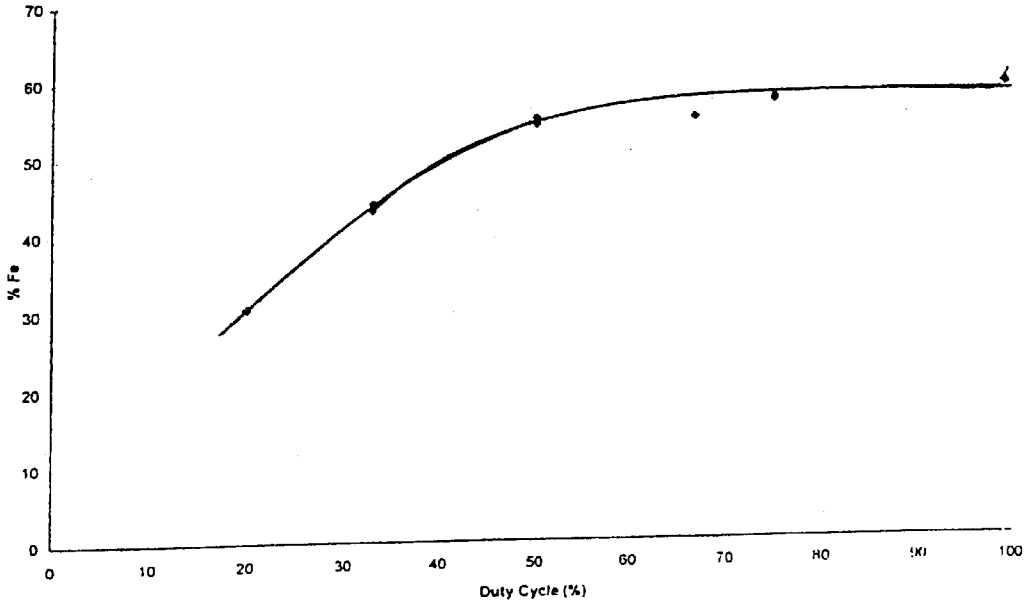
FIG. 6 is a graph depicting the relationship between the percentage of Fe in plated NiFe material as a function of duty cycle.

The variation in the percentage of Fe in the plated material as a function of duty cycle is generally depicted in the graph of FIG. 6. As is seen in FIG. 6, the percentage of Fe in the plated NiFe material is lowest when the duty cycle is lowest, and greatest when the duty cycle is greatest. The reasons for the variations in the plated NiFe composition with the duty cycle are complex and may include such effects as the dissolving of plated Fe during the off portion of the duty cycle at a greater rate than plated Ni, and differences in the diffusion of Ni and Fe ions within the plating bath during the current-on and current-off portions of the duty cycle. However, a significant feature of the present invention is that electroplated material having differing Ni and Fe compositions can be controllably obtained from a single NiFe plating bath chemistry by altering the electroplating current duty cycle.

The electroplating process of the present invention was employed in the experimental fabrication of electroplated layers upon two glass substrate wafers (A and B) with an electroplating bath of approximately 0.20M Ni ions and 0.02M Fe ions, and an electroplating current density of approximately 8 $mA/C^2$. Each electroplating process was commenced with a 100% duty cycle which was then decreased. The following analysis of the electroplated layers on the wafers (A and B) thus commences with the top surface of the layers, where the Fe concentration is the lowest as the duty cycle was lowest at the end of the electroplating process.

Figure 7:
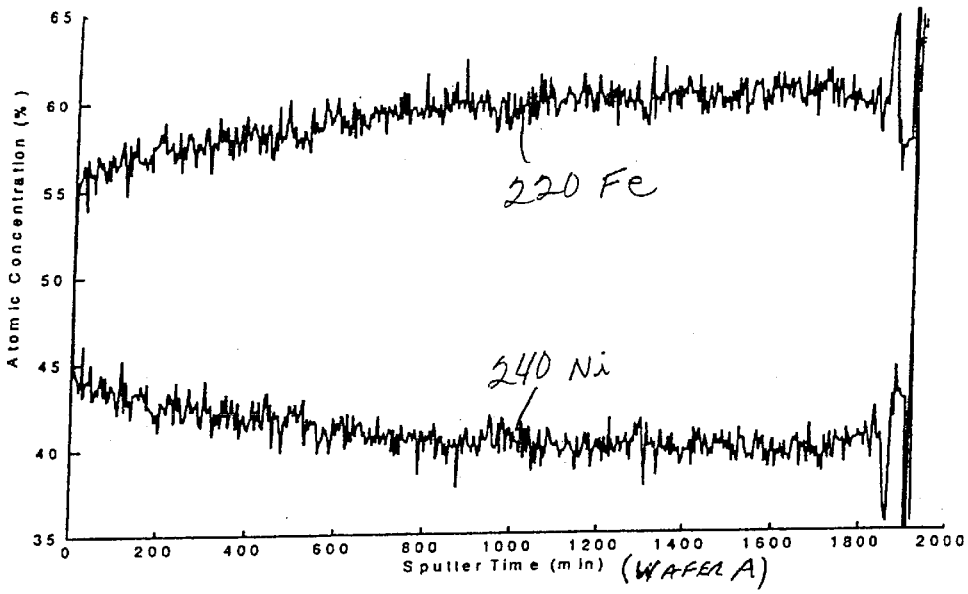
FIG. 7 is a graph depicting experimental results of electroplated NiFe material due to variation in the electroplating current duty cycle.
Figure 8:
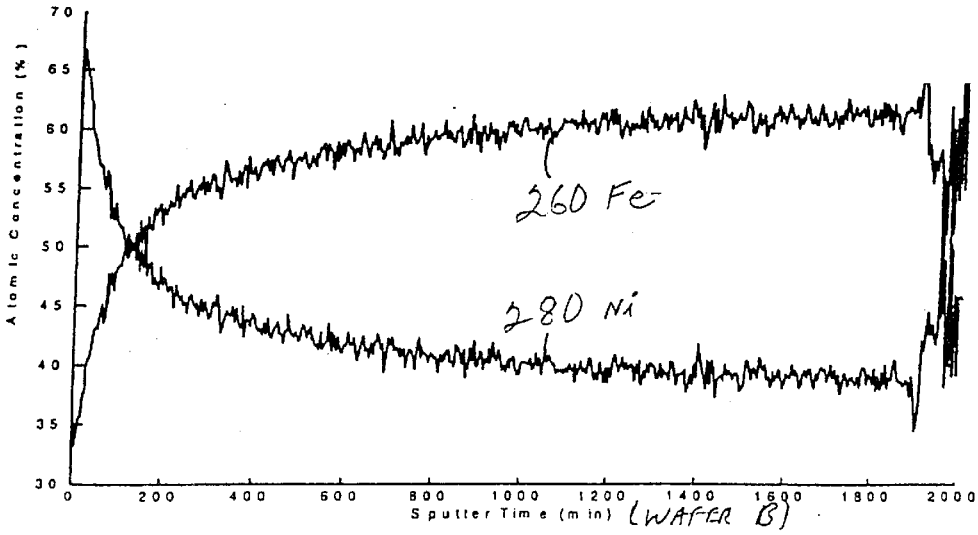
FIG. 8 is a graph depicting experimental results of electroplated NiFe material due to variation in the electroplating current duty cycle.

The two wafers, A and B, were analyzed using Auger Electron Spectroscopy to determine the NiFe composition as a function of height within the electroplated material, and FIGS. 7 and 8 are graphs depicting the experimental results for electroplated NiFe material layers on wafers A and B respectively. As depicted in FIG. 7, wafer A (duty cycle change of 100% to 50%) had an Fe concentration (line 220) ranging from about 55 wt. % at the top of the electroplated material layer (duty cycle 50%) to 60 wt. % at the bottom of the electroplated material layer next to the glass substrate (duty cycle 100%), with the Ni concentration (line 40) having corresponding values. As depicted in FIG. 8, wafer B (duty cycle change of 100% to 20%) had an Fe concentration (line 260) ranging from about 35 wt. % at the top of the electroplated material layer (duty cycle of 20%) to 60 wt. % at the bottom of the electroplated material layer next to the glass substrate (duty cycle 100%), with the Ni concentration (line 280) having corresponding values. Analysis was carried out on a Phi-680 AES instrument, using elemental depth profiles (with rotation). The atomic concentration scale is based on assumed sensitivity factors for the Ni and Fe transitions monitored. The spike to 65 wt. % Fe reading at the bottom of the electroplated material is due to the seedlayer/plated material interface and is not thought to be a true electroplated material layer composition.

Figure 9:
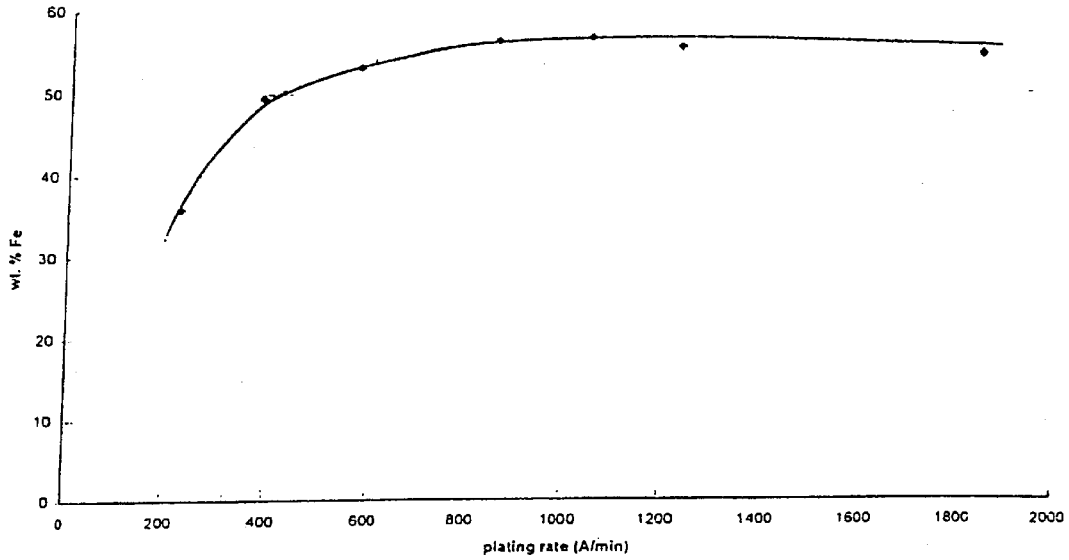
FIG. 9 is a graph depicting the relationship between Fe concentration in plated NiFe material as a function of the plating rate.
Figure 10:
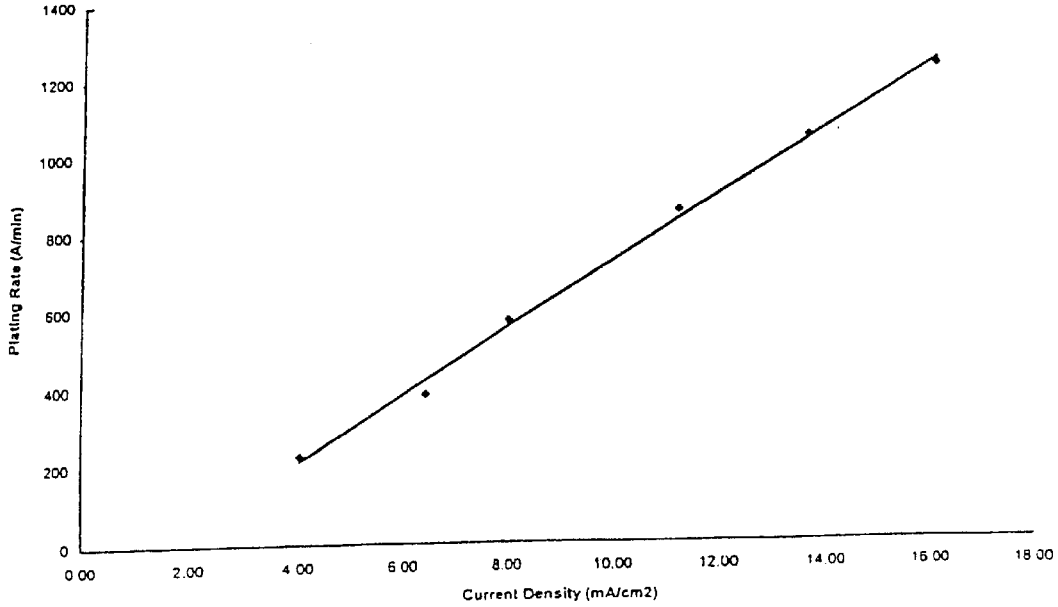
FIG. 10 is a graph depicting the relationship between the plating rate and the electroplating current density.

Variation in other electroplating parameters can also have an effect upon the percentage of Fe in the electroplated material. Specifically, FIG. 9 is a graph depicting the change in the percentage of Fe in the plated material as a function of the plating rate. It is generally seen that as the plating rate increases from approximately 200 Å per minute to approximately 600 Å per minute that the percentage of Fe increases from approximately 35 wt. % to approximately 55 wt. %. Thereafter, increasing the plating rate does not significantly affect the percentage of Fe, which remains at approximately 55 to 58 at. % With regard to the plating rate, FIG. 10 is a graph depicting the relationship between the plating rate and the plating current density. As can be seen, there is generally a linear relationship between the plating rate and the plating current density. Therefore, selection of a plating current density operates to determine the plating rate and thus a percentage of Fe in the electroplated material, where the duty cycle is 100%. Thereafter, where the duty cycle is varied, as depicted in FIGS. 6, 7 and 8, the percentage of Fe in the electroplated material can likewise be varied. In general, the electroplating current density range that is suitable for the present invention is from 1 $mA/cm^2$ to 30 $mA/cm^2$, with a preferred range of 4 $mA/cm^2$ to 16 $mA/cm^2$, and with a more preferred value of approximately 8 $mA/cm^2$. An electroplating bath of the present invention has Ni and Fe ion concentration ranges of from 5:1 Ni:Fe to 20:1 Ni:Fe ions, with a preferred electroplating bath concentration of approximately 10:1 Ni:Fe ions.

In addition to varying the electroplating current duty cycle as described hereabove, the pulse period can also be varied, as will be understood by those skilled in the art. Experimentation by the inventors in this regard has generally revealed that a variation in the pulse period, while maintaining the same duty cycle, did not result in a significant change in the percentage of Fe deposited. Therefore, the duty cycle is a significant electroplating parameter for determining the composition of the electroplated material, while variation in the pulse period is generally not a significant electroplating parameter.

While the invention has been shown and described with regard to certain preferred embodiments, it is to be understood that those skilled in the art will no doubt develop certain alterations and modifications therein, it is therefore intended that the following claims cover all such alterations and modifications that nevertheless include the true spirit and scope of the invention.

What we claim is:

1. A magnetic head including a write head, comprising:

a first (P1) magnetic pole;

a second (P2) magnetic pole;

a write gap layer being disposed between said P1 magnetic pole and said P2 magnetic pole;

at least one of said P1 magnetic pole and said P2 magnetic pole being composed of a NiFe ion composition, and wherein the ratio of Ni to Fe is graduated throughout portions of either of said P1 magnetic pole and said P2 magnetic pole; and wherein said P1 magnetic pole is formed with a first portion wherein the relative concentration of Ni and Fe is approximately constant and a second portion wherein the relative concentration of Ni and Fe ions is graduated.

2. A magnetic head as described in claim 1 wherein said second portion of said P1 magnetic pole is disposed proximate said write gap layer.

3. A magnetic head as described in claim 2 wherein the Fe concentration in said second portion varies from approximately 20 wt. % to approximately 60 wt. %.

4. A magnetic head as described in claim 3 wherein a portion of said second portion having an Fe concentration of approximately 60 wt. % is disposed proximate said write gap layer.

5. A magnetic head including a write head, comprising:

a first (P1) magnetic pole;

a second (P2) magnetic pole;

a write gap layer being disposed between said P1 magnetic pole and said P2 magnetic pole;

at least one of said P1 magnetic pole and said P2 magnetic pole being composed of a NiFe ion composition, and wherein the ratio of Ni to Fe is graduated throughout portions of either of said P1 magnetic pole and said P2 magnetic pole; and wherein said P2 magnetic pole is formed with a first portion wherein the relative concentration of Ni and Fe is graduated, and a second portion wherein the relative concentration of Ni and Fe is approximately constant.

6. A magnetic head as described in claim 5 wherein said first portion of said P2 magnetic pole is disposed proximate said write gap layer.

7. A magnetic head as described in claim 6 wherein the Fe concentration in said first portion varies from approximately 60 wt. % to approximately 20 wt. %.

8. A magnetic head as described in claim 7 wherein a portion of said first portion having said approximately 60 wt. % Fe concentration is disposed proximate said write gap layer.

9. A magnetic head including a write head, comprising:

a first (P1) magnetic pole being composed of a NiFe composition, wherein a portion of said P1 magnetic pole is formed with the relative concentration of Ni and Fe being approximately constant, and the ratio of Ni to Fe is graduated throughout other portions of said P1 magnetic pole;

a second (P2) magnetic pole being composed of a NiFe composition, and wherein a portion of said P2 magnetic pole is formed with the relative concentration of Ni and Fe being approximately constant, and the ratio of Ni to Fe is graduated throughout other portions of said P2 magnetic pole;

a write gap layer being disposed between said P1 magnetic pole and said P2 magnetic pole.

10. A magnetic head as described in claim 9 wherein said portion of said P1 pole having said graduated composition is disposed proximate said write gap layer, and said portion of said P2 magnetic pole having said graduated composition is disposed proximate said write gap layer.

11. A magnetic head as described in claim 10 wherein the Fe concentration within said portion of said P1 magnetic pole having said graduated composition varies from approximately 20 wt. % to approximately 60 wt. %, and wherein the Fe concentration of said P1 magnetic pole proximate said write gap layer is approximately 60% wt. %; and wherein the Fe concentration within said portion of said P2 magnetic pole having said graduated composition varies from approximately 60 wt. % to approximately 20 wt. %; and wherein the Fe concentration of said P2 magnetic pole proximate said write gap layer is approximately 60 wt. %.

12. A hard disk drive including a magnetic head that includes a write head, comprising:

a first (P1) magnetic pole being composed of a NiFe composition, wherein a portion of said P1 magnetic pole is formed with the relative concentration of Ni and Fe being approximately constant, and the ratio of Ni to Fe is graduated throughout other portions of said P1 magnetic pole;

a second (P2) magnetic pole being composed of a NiFe composition, and wherein a portion of said P2 magnetic pole is formed with the relative concentration of Ni and Fe being approximately constant, and the ratio of Ni to Fe is graduated throughout other portions of said P2 magnetic pole;

a write gap layer being disposed between said P1 magnetic pole and said P2 magnetic pole.

13. A hard disk drive as described in claim 12 wherein said portion of said P1 pole having said graduated composition is disposed proximate said write gap layer, and said portion of said P2 magnetic pole having said graduated composition is disposed proximate said write gap layer.

14. A hard disk drive as described in claim 13, wherein the Fe concentration within said portion of said P1 magnetic pole having said graduated composition varies from approximately 20 wt. % to approximately 60 wt. %, and wherein the Fe concentration of said P1 magnetic pole proximate said write gap layer is approximately 60 wt. %; and wherein the Fe concentration within said portion of said P2 magnetic pole having said graduated composition varies from approximately 60 wt. % to approximately 20 wt. %; and wherein the Fe concentration of said P2 magnetic pole proximate said write gap layer is approximately 60 wt. %.

* * * * *